United States Patent [19]

Noguchi et al.

[11] 4,237,831

[45] Dec. 9, 1980

[54] TWO-CYCLE ENGINE

[75] Inventors: Masaaki Noguchi, Nagoya; Taro Tanaka; Norikatsu Uejima, both of Chiryu, all of Japan; Yukiyasu Tanaka, deceased, late of Okazaki, Japan; by Koichiro Tanaka, successor, Himeji; by Mihoko Miyazaki, successor, Kobe, both of Japan

[73] Assignee: Nippon Soken, Inc., Nishio, Japan

[21] Appl. No.: 961,369

[22] Filed: Nov. 16, 1978

[30] Foreign Application Priority Data

| | | | |
|---|---|---|---|
| Nov. 18, 1977 | [JP] | Japan | 52-139093 |
| Nov. 24, 1977 | [JP] | Japan | 52-141181 |
| Dec. 22, 1977 | [JP] | Japan | 52-155338 |

[51] Int. Cl.[3] ..... F02B 25/08; F02B 25/20

[52] U.S. Cl. ..... 123/51 BA; 123/51 BD; 123/53 BA; 123/65 A; 123/73 A

[58] Field of Search ..... 123/51 R, 51 B, 51 BA, 123/51 BD, 73 R, 73 A, 73 AC, 73 B, 73 SC, 53 B, 53 R, 53 BA

[56] References Cited

U.S. PATENT DOCUMENTS

| | | | |
|---|---|---|---|
| 884,040 | 2/1907 | Oechelhaeuser | 123/65 A |
| 1,780,635 | 11/1930 | Spencer | 123/73 A |
| 2,345,056 | 3/1944 | Mallory | 123/51 BA |
| 2,844,131 | 7/1958 | Beveridge | 123/51 BA |
| 3,817,227 | 6/1974 | Onishi | 123/73 A |
| 3,923,019 | 12/1975 | Yamada | 123/53 BA |
| 4,071,000 | 1/1978 | Herbert | 123/51 BA |

FOREIGN PATENT DOCUMENTS

| | | |
|---|---|---|
| 182568 | 12/1954 | Austria . |
| 98630 | 12/1916 | Switzerland . |

*Primary Examiner*—Charles J. Myhre
*Assistant Examiner*—Craig R. Feinberg
*Attorney, Agent, or Firm*—Cushman, Darby & Cushman

[57] ABSTRACT

A two-cycle engine including first set of passages formed outside a cylinder connecting a first crank case with scavenging ports for feeding air-fuel mixtures from the first crank case to the cylinder, second set of passages formed outside the cylinder connecting a second crank case with the scavenging ports for feeding air-fuel mixtures from the second crank case to the cylinder, and scavenging gas merging chamber cooperative with the first and second sets of passages and located upstream of the scavenging ports for restricting flow of air-fuel mixtures in vicinity of the scavenging ports. First and second pistons are mounted in opposed relation to each other in the cylinder, the first piston opening and closing an exhaust port and the second piston opening and closing the scavenging ports. The scavenging ports are formed substantially tangentially of the cylinder in a plane normal to the latter, so charges of mixtures gently introduced into the cylinder flow along the top of the second piston in vortical form and the mixtures thus introduced and burned gases remaining in the cylinder are arranged in stratified relation. Fuel in the mixtures in the boundary of the two stratified masses is heated by the heat of the burned gases and the heat caused by the compression stroke of the pistons and has its temperature raised producing radicals of $C_2$, CH, CHO, OOH and H. These radicals provide multitude of sources of ignitiion enabling compression-ignition of the mixtures to be effected.

9 Claims, 16 Drawing Figures

TWO-CYCLE ENGINE

This invention relates to uniflow, two-cycle engines of the opposed piston type, and more particularly to a method of operating a two-cycle engine and a two-cycle engine itself wherein fuel consumption is improved and the amount of HC in the exhaust gasses is reduced by virtue of a novel combustion system.

Generally, uniflow, two-cycle engines have advantages that, since the air-fuel mixture flows only in one direction in the cylinder, they are relatively higher in scavenging efficiency and less mixture flows out of the combustion chamber than in Schnürle type engines. However, some disadvantages are associated with them. Owing to the presence of residual gases in the engine, ignition of the mixture is unstable if spark ignition is used, thereby causing a misfiring cycle to occur in the range between low and no load operation of the engine. Moreover, fuel consumption is high and the amounts of HC in the exhaust gases are large. Since the ignition is unstable, the driver and passengers are annoyed by unpleasant vibrations and noise.

This invention has been developed for the purpose of obviating the aforementioned disadvantages of the prior art. The invention has as its object the provision of a method of operation of a two-cycle engine and a two-cycle engine itself wherein the rate of misfiring is lowered, fuel consumption is improved, the amounts of HC in the exhaust gases are reduced, and unpleasant vibrations and noise are suppressed.

According to the invention, there is provided a two-cycle engine comprising a cylinder provided with an exhaust port and scavenging port means, a first crank case and a second crank case each connected to one of two ends of said cylinder, a first portion and a second piston housed in said cylinder in opposed relation, said first piston being operative to open and close said exhaust port, said second piston being operative to open and close said scavenging port means, and first and second air-fuel mixture supply means connected to said first and second crank cases, respectively, such an engine being characterized by further comprising first passage means formed outside of said cylinder to connect said first crank case with said scavenging port means for feeding an air-fuel mixture from said first crank case to said cylinder, second passage means formed outside of said cylinder to connect said second crank case with said scavenging port means for feeding an air-fuel mixture from said second crank case to said cylinder, and means, cooperative with said first and second passage means, located upstream of said scavenging port means for restricting the flow of said air-fuel mixtures in said first and second passage means to moderate the flow of said air-fuel mixtures in the vicinity of said scavenging port means in said cylinder.

In a scavenging stroke of the engine, the air-fuel mixture flows in a moderate scavenging stream along the top of the second piston to be introduced into the cylinder, and, although there are large amounts of burned residual gases inside the cylinder at this time, the air-fuel mixture can be supplied in stratified relation with respect to said residual gasses without the scavenging stream of the air-fuel mixture being mixed with the residual gases because of the fact that the former is introduced in moderate and gentle flow along the top of the second piston. Thereafter, in a compression stroke, a portion of the air-fuel mixture disposed in the boundary between the air-fuel mixture and the residual gases has its temperature raised by the heat of the residual gases. As the compression stroke progresses, the temperature of this portion of the air-fuel mixture further rises due to adiabatic compression, with the result that a portion of the fuel of the air-fuel mixture in the boundary undergoes decomposition to produce chemically active radicals of $C_2$, CH, OOH, CHO and H. These radicals provided a multitude of sources of ignition, so that compression-ignition of the air-fuel mixture can be effected without relying on spark ignition.

According to the invention, the engine is operated in such a manner that these chemically active radicals are produced in the fuel of the air-fuel mixture in the cylinder to enable compression-ignition of the air-fuel mixture to be effected. The air-fuel mixture is positively ignited in each cycle, and the amounts of HC in the exhaust gases can be greatly reduced. Thus, the invention obviates the aforesaid disadvantages of the prior art.

The above and other objects, features and advantages of the invention will become more apparent from the description of the illustrative embodiments thereof set forth hereinafter when considered in conjunction with the accompanying drawings, in which.

The embodiments of the invention will now be described by referring to the accompanying drawings.

Figure 1:
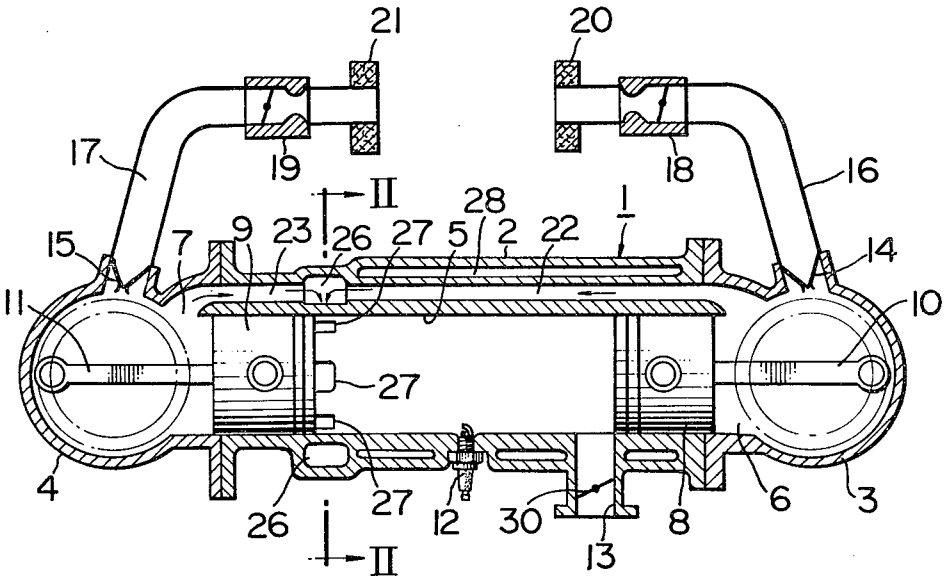
FIG. 1 is a schematic sectional view of the two-cycle engine comprising a first embodiment of the invention.
Figure 2:
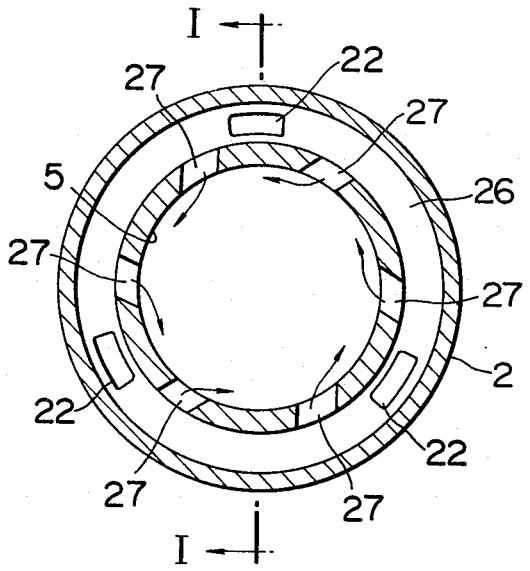
FIG. 2 is a sectional view taken along the line II—II in FIG. 1.

In FIGS. 1 and 2 showing a first embodiment of the invention, a main body 1 of the two-cycle engine comprises a cylinder block 2, a first crank case 3 and a second crank case 4. The cylinder block 2 has a cylinder 5 formed therein, and the crank cases 3 and 4 define therein crank chambers 6 and 7 respectively.

First and second pistons 8 and 9 each having a flat top are mounted in the cylinder 5 in opposed relation for reciprocatory movement. The first and second pistons 8 and 9 are designed such that the compression ratio is between 4 and 10. The pistons 8 and 9 are connected by piston rods 10 and 11, respectively, to crank shafts not shown.

An ignition plug 12 is arranged in the central portion of the cylinder 5 for effecting spark ignition of an air-fuel mixture. An exhaust port 13 for exhausting combusted gases from the cylinder 5 is formed in the cylinder block 2 in a position in which the port 13 is opened and closed by the first piston 8.

Reed valves 14 and 15, which open only in a direction in which an air-fuel mixture is admitted to the crank chambers 6 and 7, are arranged in air-fuel inlets of the crank cases 3 and 4 respectively. Carburetors 18 and 19 for supplying mixtures of a fuel (gasoline) and air to the crank cases 3 and 4 are connected through intake pipes 16 and 17 to the crank cases 3 and 4 respectively. The carburetors 18 and 19 have air cleaners 20 and 21 respectively.

Communication is maintained between the cylinder 5 and the crank chambers 6 and 7 by way of three pairs of scavenging passages 22 and 23 and a scavenging gas merging chamber 26. More specifically, the scavenging passages 22 and 23 opposed to each other communicate with the annular scavenging gas merging chamber 26 formed in the cylinder block 2 and communicating with the cylinder 5 through six scavenging ports 27. Each of the scavenging ports 27 opens substantially tangentially in a plane which is perpendicular to the cylinder 5, so that streams of the air-fuel mixture introduced into the cylinder through the scavenging ports 27 flow along the top of the second piston 9 in vortical vorm. 28 designates an engine cooling water passage which is located adjacent to the scavenging passages 22. The exhaust port 13 has mounted therein an exhaust throttle valve 30 of the butterfly type which can be actuated as desired.

In the two-cycle engine constructed as aforesaid, the scavenging ports 27 and the exhaust port 13 are opened and closed, as is well known, by the reciprocating movement of the pistons 9 and 8 respectively. The exhaust port 13 first opens when the pistons 8 and 9 move from the top dead center toward the bottom dead center or during a scavenging stroke, and then the scavenging ports 27 open. The air-fuel mixtures formed in the carburetors 18 and 19 are drawn into the crank chambers 6 and 7 through the inlet pipes 16 and 17 and the reed valves 14 and 15 respectively, during a compression stroke of the engine, in the same manner as in a conventional two-cycle engine of the crank chamber compression type.

During the scavenging stroke, the air-fuel mixtures introduced into the crank chambers 6 and 7 are led, as scavenging streams of air-fuel mixture, to the scavenging gas merging chamber 26 by way of the scavenging passages 22 and 23 respectively. In the scavenging gas merging chamber 26, the direction of flow of the scavenging streams is changed from a direction parallel to the axis of the cylinder 5 to a direction perpendicular thereto. Moreover, since the axially opposed scavenging streams impinge against each other before changing their direction of flow, the scavenging streams are moderated into gentle streams.

When the piston 8 passes the top dead center to open the exhaust port 13, the blow-down of burned gases takes place and the pressure in the cylinder 5 becomes equal to the atmospheric pressure. Then, when the piston 9 further moves toward the bottom dead center, the scavenging ports 27 open to allow the gentle scavenging streams of air-fuel mixture to flow tangentially into the cylinder 5.

Since the scavenging streams have their direction of flow changed by the scavenging gas merging chamber 26 into a direction which is perpendicular to the axis of the cylinder 5, the scavenging streams have almost no velocity component directed axially of the cylinder 5 and therefore flow in vortical form along the top of the piston 9.

At this time, large amounts of residual gases are present in the cylinder 5. Since the scavenging streams are admitted to the cylinder 5 along the top of the piston 9, admixing of the air-fuel mixtures, which constitute the scavenging streams, with the residual gases is avoided and feeding of the air-fuel mixtures in stratified relation is effected, with the residual gases formed in the combustion of the mixtures in the preceding cycle being present in a rightward portion of the cylinder 5 as viewed in FIG. 1 and the air-fuel mixtures supplied as scavenging streams being present in a leftward portion of the cylinder 5.

If the exhaust throttle valve 30 is actuated at this time to throttle the exhaust gas stream, it is possible to avoid a sudden reduction in pressure within the cylinder 5 which would otherwise take place when the exhaust port 13 is opened. This further moderates the scavenging streams flowing into the cylinder 5, thereby ensuring that the air-fuel mixtures supplied as the scavenging streams are fed in stratified relation with respect to the residual gases without mixing therewith.

Thereafter, the portion of the air-fuel mixtures disposed in the boundary between the air-fuel mixtures and the residual gases in the cylinder 5 is heated by the residual gases to a high temperature during the compression stroke. Movement of the pistons 8 and 9 toward the top dead center causes adiabatic compression to take place within the cylinder 5, with the result that a portion of the fuel in the air-fuel mixtures in the boundary undergoes decomposition and is activated to produce radicals of high chemical activity (intermediate products of combustion) of $C_2$, CH, OOH, CHO and H.

These radicals are chemically active and highly combustible, and provide a multitude of ignition sources in the boundary between the air-fuel mixtures and the residual gases. Thus, the air-fuel mixture containing these radicals is compressed during the compression cycle and ignited by compression-ignition without using the ignition plug 12 for effecting spark ignition. The air-fuel mixture burns satisfactorily after being ignited by compression-ignition and the energy of its combustion drives the crank shafts by way of the pistons 8 and 9 and piston rods 10 and 11.

Figure 3:
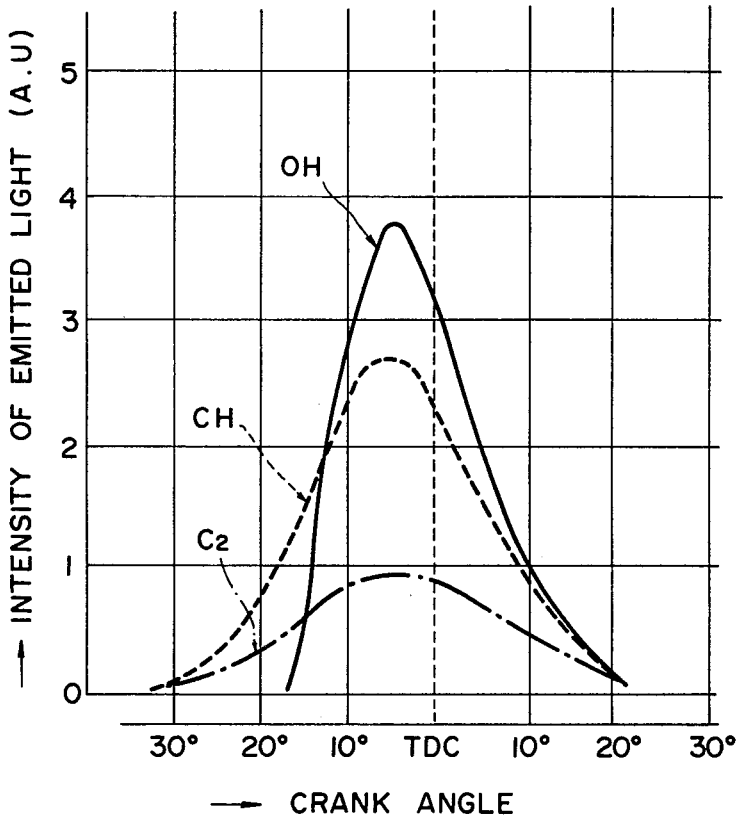
FIGS. 3 and 4 are graphs in explanation of the operation of the two-cycle engine.
Figure 4:
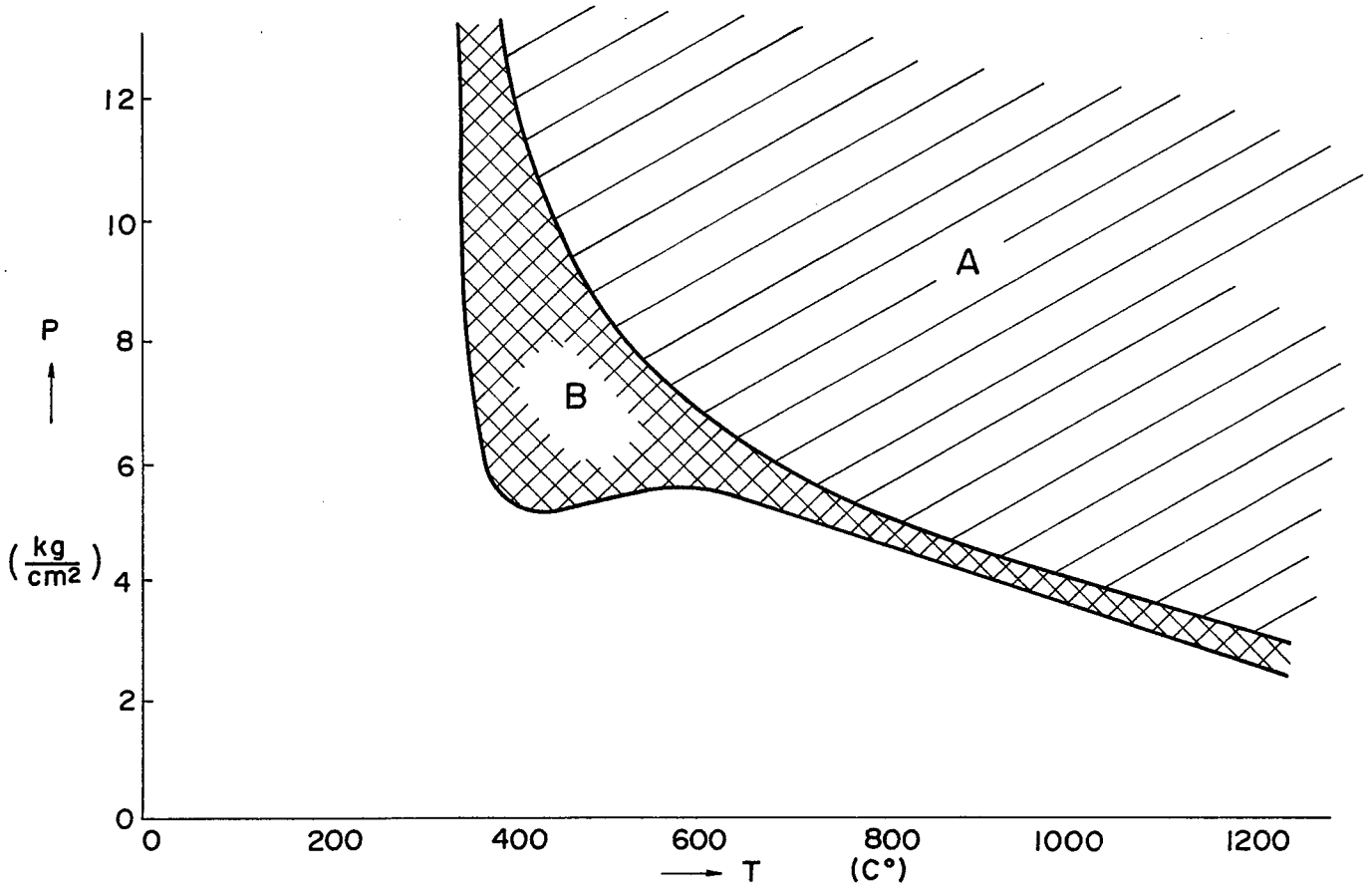

The production of the radicals in the cylinder 5 has been measured optically. FIG. 3 shows the amounts of the radicals produced which have been determined by the intensity of emitted light. As can be seen in FIG. 3, the radicals of CH and $C_2$ which are particularly combustible are produced from about 30° of the top dead center, and thereafter the radical of OH is produced. Therefore, ignition can be effected efficiently by compression-ignition, so that compression-ignition of the air-fuel mixtures can be effected even if the compression ratio is as low as 4 to 10. FIG. 4 shows the results of tests conducted on the engine according to the invention. The results of the tests show that, as illustrated in FIG. 4 which shows a cylinder pressure-combustion temperature characteristic with P designating the pressure in the cylinder and T designating the temperature of combustion, the engine according to the invention can be operated in a region B which is low in pressure and temperature, as contrasted with a diesel engine which can operate only in a region A which is high in pressure and temperature. In the present invention, radicals of components of the fuel are produced and used for effecting compression-ignition of the air-fuel mixtures as aforesaid. This enables ignition to be effected positively in each cycle and allows the engine to operate smoothly without producing any unpleasant noise and vibration. Improvement in ignition efficiency is conductive to greatly reduce HC in the exhaust gases, and enables a lean mixture to be used, thereby greatly improving fuel consumption.

It is not essential that the ignition plug 12 be mounted. It is used when necessary, when it is mounted.

In the aforesaid first embodiment, carburetors are used for supplying mixtures to the engine. Instead, fuel injection valves may be mounted in the inlet pipes 16 and 17 for supplying air-fuel mixtures to the engine.

Figure 5:
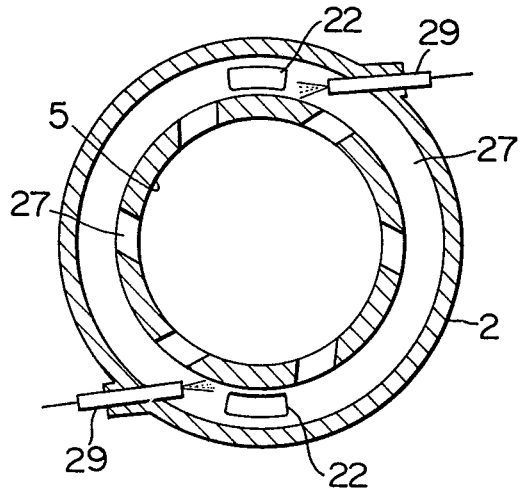
FIG. 5 is a sectional view of the essential portions of the engine showing a modification of the air-fuel mixture feeding means.

As shown in FIG. 5, fuel injection valves 29 may be mounted in the scavenging gas merging chamber 26. Alternatively, they may be mounted in the scavenging passages. When this is the case, scavenging gas streams fed from the crank chambers 6 and 7 only consist of air which is mixed with fuel after the scavenging gas streams have left the crank chambers 6 and 7.

As described hereinabove, in the first embodiment of the invention, a scavenging gas merging chamber is formed in the cylinder block and scavenging gas streams are introduced in moderate and gentle flow from this chamber into the cylinder in a direction which is perpendicular to the axis of the cylinder. By this arrangement, it is possible to supply air-fuel mixtures in stratified relation with respect to the residual gases in the cylinder, thereby enabling compression-ignition of the air-fuel mixtures to be effected. The engine can be operated at a low compression ratio of 4 to 10, it is possible to reduce the weight of the engine main body as compared with a diesel engine, and ignition can be effected positively in each cycle because ignition is effected by compression-ignition. As the result, the engine produces less vibration and noise than conventional engines, fuel consumption can be improved, the amounts of HC in the exhaust gases can be reduced, and production of irritating odors can be avoided.

Figure 6:
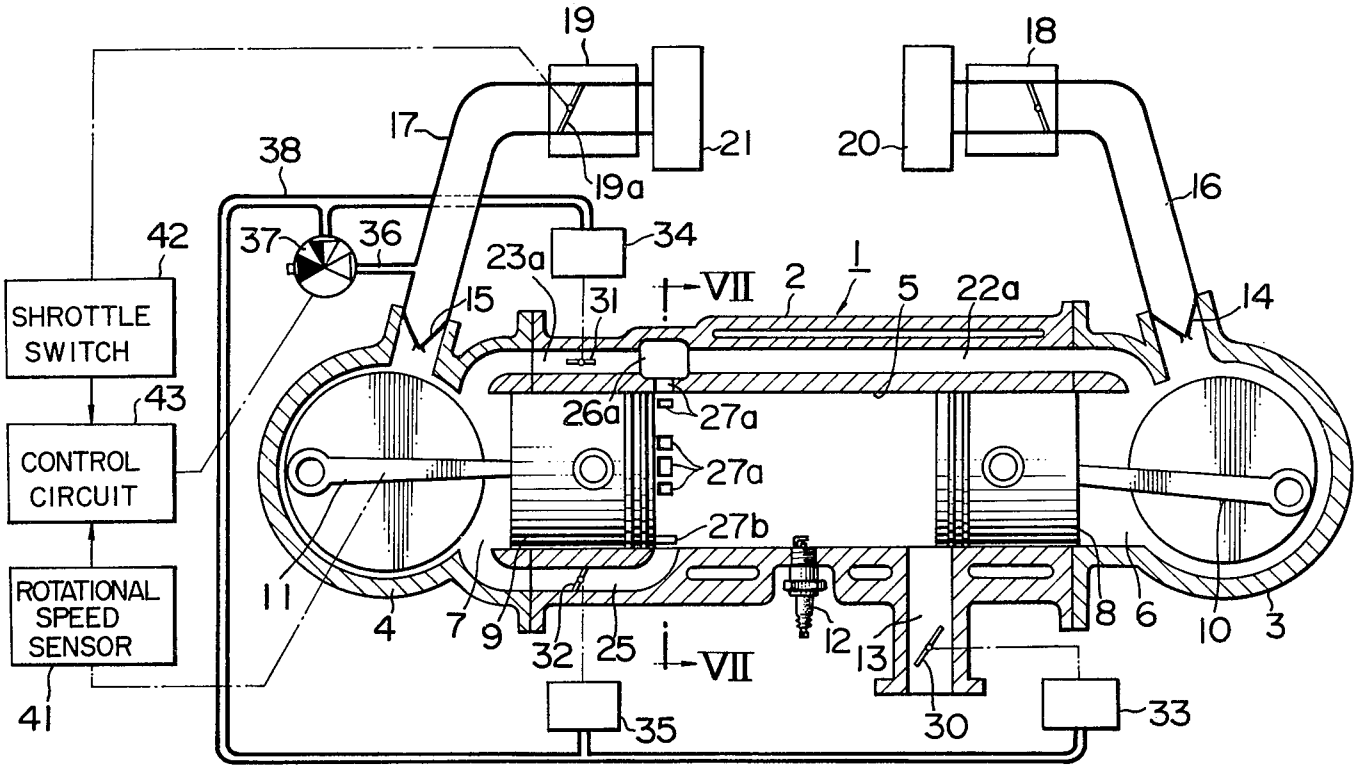
FIG. 6 is a schematic sectional view of the two-cycle engine comprising a second embodiment of the invention.
Figure 7:
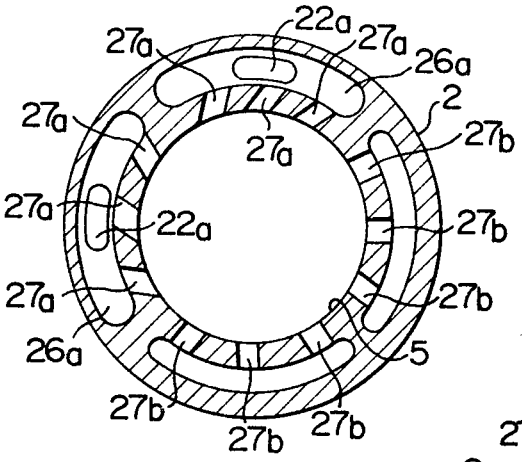
FIG. 7 is a sectional view taken along the line VII—VII in FIG. 6.

FIGS. 6 and 7 show a second embodiment of the invention which is intended to increase ignition efficiency by effecting ignition of air-fuel mixtures by compression-ignition utilizing the produced redicals in the range between low and no load operation of the engine and by effecting ignition of the mixtures by spark ignition by actuating the spark plug in the range between medium and high load operation of the engine, by taking into consideration the fact that ignition of the mixtures is particularly unstable in the aforesaid conventional uniflow, two-cycle engine of the opposed piston type in the range between low and no load operation of the engine due to the large amounts of burned gases (residual gases) present in the cylinder.

In FIGS. 6 and 7, parts similar to those shown in FIGS. 1 and 2 are designated by like reference characters, and description of the parts 1 to 21 will be omitted.

The cylinder 5 is maintained in communication with the crank chamber 6 through first scavenging passages 22*a* and scavenging gas merging chambers 26*a*, while the cylinder is maintained in communication with the crank chamber 7 through second scavenging passages 23*a* and the scavenging gas merging chambers 26*a* and through third scavenging passages 25.

The first and second scavenging passages 22*a* and 23*a* are arranged to be opposed to the scavenging gas merging chambers 26*a* which communicate with the cylinder 5 through scavenging ports 27*a*. Each of the scavenging ports 27*a* opens substantially tangentially of the cylinder 5 in a plane which is perpendicular to the cylinder 5, so that scavenging gas streams admitted through the scavenging ports 27*a* into the cylinder 5 flow along the top of the piston 9 in vortical form.

The third scavenging passages 25 and scavenging ports 27*b* communicate the crank chamber 7 with the cylinder 5, with the scavenging ports 27*b* opening in the direction of the central portion of the cylinder 5 to allow scavenging air streams to flow in the direction of the ignition plug 12.

The pistons 8 and 9 are arranged such that there is a phase difference between them, with the phase of the piston 8 being slightly advanced than that of the piston 9.

An exhaust throttle valve 30 of the butterfly type is mounted in the exhaust port 13, a first scavenging gas throttle valve 31 of the butterfly type is mounted in each of the second scavenging passages 23*a*, and a second scavenging gas throttle valve 32 of the butterfly type is mounted in each of the third scavenging passages 25.

A control unit for controlling the degree of opening of each of the throttle valves 30 to 32 will be described. The control unit comprises diaphragm means 33, 34 and 35, conduits 36 and 38, an electromagnetic three-way valve 37, a rotational speed sensor 41, a throttle switch 42 and a control circuit 43.

The throttle valves 30 to 32 are actuated by the diaphragm means 33, 34 and 35 respectively. If the negative pressure in the inlet pipe 17 is introduced into the diaphragm means 33, 34 and 35 through the conduits 36 and 38 and the electromagnetic three-way valve 37, then diaphragms, not shown, are displaced to reduce the degree of opening of the throttle valve 30 and the second scavenging gas throttle valves 32 so that the throttle valve 30 will be half open and the second scavenging gas throttle valves 32 will be fully closed or partly open. At the same time, the degree of opening of the first scavenging gas throttle valves 31 is increased, so that the throttle valves 31 will be fully open or half open.

On the other hand, if atmospheric pressure is introduced into the diaphragm means 33, 34 and 35, then the degree of opening of the throttle valve 30 and the second scavenging gas throttle valves 32 is increased, and the degree of opening of the first scavenging gas throttle valves 31 is reduced, so that the throttle valve 30 will be fully open, the second throttle valves 32 will be fully open and the first throttle valves 31 will be fully closed.

The electromagnetic valve 37 performs the function of switching a pressure signal introduced into the conduit 38 between suction negative pressure and atmospheric pressure. When energized, the valve 37 introduces suction negative pressure from conduit 36 to conduit 38; when de-energized, the valve 37 introduces atmospheric pressure into conduit 38.

Energization and de-energization of the electromagnetic valve 37 are controlled by the control circuit 43 to which signals are inputted from the rotational speed sensor 41. The rotational speed sensor 41, which detects the engine speed of the engine 1 and is known, may include a crank gear and an electromagnetic pick-up, for example. The sensor 41 produces an output signal in conformity with the rotational speed of the engine. The throttle switch 42, which detects the degree of opening of a throttle valve 19*a* of the carburetor 19, is turned on when the degree of opening of the throttle valve 19*a* is below a predetermined level, so as to produce an electric signal indicating that the engine 1 is at low or no load operation.

The control circuit 43 comprises a comparator circuit and a drive circuit which are known, and produces and supplies an operative signal to the electromagnetic valve 37 when the engine operates at low or no load.

In the aforesaid construction, the exhaust port 13 and the scavenging ports 27*a* and 27*b* are opened and closed by the reciprocating movement of the pistons 8 and 9 as is well known. The exhaust port 13 first opens when the pistons 8 and 9 move from the top dead center toward the bottom dead center or in a scavenging stroke, and then the scavenging ports 27*b* and 27*a* open. Air-fuel mixtures formed in the carburetors 18 and 19 are introduced into the crank chambers 6 and 7 through the inlet pipes 16 and 17 and the reed valves 14 and 15 respectively, in the same manner as in a two-cycle engine of the crank chamber compression type of the prior art.

When the engine 1 operates in the range between medium and high load, throttle valve 19*a* is opened to a degree which is above the predetermined level, so that the control circuit 43 de-energizes the electromagnetic valve 37 so as to introduce atmospheric pressure to the diaphragm means 33 to 35. In this way, the exhaust valve 30 is fully opened, the first scavenging gas throttle valves 31 are fully closed and the second scavenging gas throttle velves 32 are fully opened.

Thus, air-fuel mixtures are supplied to the cylinder 5 through the scavenging passages 22*a* and 25 and ignited by the spark plug 12. Exhaust gases are vented through the exhaust port 13 after the mixtures are burned, so that the engine 1 operates in a conventional spark ignition system.

Of the two opposed pistons 8 and 9, the piston 8 on the side of the exhaust port 13 is slightly advanced in phase as compared with the piston 9 so as to cause the exhaust port 13 to open earlier than would otherwise be the case. In this way, the exhausting of exhaust gases is effected to enable scavenging to be carried out satisfactorily, so that scavenging efficiency can be increased.

In the range between low speed low load and no load operation of the engine in which the degree of opening of the throttle valve 19*a* is reduced and the engine speed is also reduced, the throttle switch 42 is turned on and the rotational speed sensor 41 detects a low rotational speed, so that the control circuit 43 will produce an operative signal to energize the electromagnetic valve 37 to thereby introduce intake negative pressure into the diaphragm means 33 to 35.

Then, the diaphragm means 33 to 35 half open the throttle valve 30 as shown in FIG. 1, fully open the first scavenging gas throttle valves 31 and fully close the second scavenging gas throttle valves 32.

When the exhaust port 13 opens following the movement of the piston 8 toward the bottom dead center after passing the top dead center, blow-down of the combusted gases occurs and the pressure in the cylinder 5 becomes substantially equal to the atmospheric pressure. Further movement of the piston 8 toward the bottom dead center opens the scavenging ports 27*a* and allows the scavenging gas streams to flow along the top of the piston 9 and to be introduced into the cylinder 5 tangentially thereof.

In this scavenging process, the air-fuel mixtures introduced into the crank chambers 6 and 7 are led, as scavenging gas streams, to the scavenging gas merging chambers 26*a* through the scavenging passages 22*a* and 23*a* where the direction of flow of the scavenging gas streams is changed from a direction which is parallel to the axis of the cylinder 5 to a direction which is perpendicular to the axis of the cylinder 5 and the opposed streams impinge against each other. Thus, the scavenging gas streams become moderate and gentle when introduced into the cylinder 5.

Also, since the scavenging gas streams have their direction of flow changed by the scavenging gas merging chambers 26*a* to a direction which is perpendicular to the axis of the cylinder 5, the scavenging gas streams have almost no velocity component directed axially of the cylinder 5, so that the scavenging gas streams flow in vortical form along the top of the piston 9.

At this time, large amounts of residual gases are present in the cylinder 5. However, since the scavenging gas streams are introduced along the top of the piston 9 into the cylinder 5, the air-fuel mixtures of the scavenging gas streams are prevented from mixing with the residual gases. Thus, the residual gases produced by combustion of the mixtures in the preceding cycle are disposed on the right side of the cylinder 5 in FIG. 6 and the introduced mixtures are disposed on the left side of the cylinder 5, so that the gases are arranged in stratified relation.

Owing to the throttling of an exhaust gas stream by the exhaust throttle valve 30, a sudden reduction in the pressure in the cylinder 5 which would otherwise occur when the exhaust port 13 is opened is prevented, thereby further moderating the scavenging gas streams flowing into the cylinder 5 and ensuring that the mixtures can be supplied in stratified relation with respect to the residual gases.

Thereafter, in a compression stroke, compression-ignition of air-fuel mixture by the generation of radicals in the same manner as mentioned in the description of the first embodiment, takes place.

The mixtures thus ignited by compression-ignition burn well and the energy of combustion drives the crank shafts by way of the pistons 8 and 9 and the piston rods 10 and 11.

The manner in which the radicals are produced in the cylinder 5 is as described by referring to FIG. 3 with regard to the first embodiment. The mixtures can be ignited with a high degree of efficiency, and compression ignition can be effected even if the compression ratio is as low as 4 to 10. This has already been described by referring to FIG. 4. In this embodiment, compression-ignition is effected by producing radicals in the range between low and no load operation of the engine, so that ignition can be effected positively in each cycle and the engine can be operated with minimized noise production. An increase in ignition efficiency enables the amounts of HC in the exhaust gases to be greatly reduced as compared with conventional engines of the spark ignition system, and permits lean mixtures to be used, thereby improving fuel consumption.

The spark plug 12 need not be actuated in the range between low and no load operation of the engine. This is conductive to reduced power consumption as compared with conventional engines of the spark ignition system.

In the aforesaid embodiment, carburetors are used for supplying mixtures to the cylinder. It is to be understood that fuel injection valves may be mounted in the mixture conduits to supply mixtures to the cylinder. The fuel injection valves may be provided in the scavenging passages. When this is the case, scavenging gas streams led from the crank chambers consist only of air and are mixed with fuel by the fuel injection valves after they are released from the crank chambers.

As aforesaid, in the second embodiment, mixtures are supplied in stratified relation with respect to the residual gases in the cylinder, and the mixtures can be ignited by compression-ignition at low or no load operation of the engine. Thus, the engine can be operated at a low compression ratio of 4 to 10, and, since the mixtures are ignited by compression-ignition, ignition can be effected positively in each cycle. The engine can be operated without producing vibrations and noise fuel consumption can be improved, the amounts of HC in the exhaust gases can be reduced, and production of irritating odors can be avoided.

A third embodiment of the invention shown in FIGS. 8 to 16 will now be described. In this embodiment, in the range between low and no load operation of the engine, air-fuel mixtures are supplied to the cylinder in the form of moderate and gentle streams, so that the mixtures and the residual gases can be distributed in stratified relation in the cylinder and the mixtures can be ignited by compression-ignition by virtue of the radicals produced, but in the range between medium and high load operation of the engine, lean mixtures or air is first introduced into the cylinder to scavenge the combusted gases therefrom and then rich mixtures are supplied thereto and compressed by the pistons for ignition by spark ignition by actuating the spark plug.

By this features, the third embodiment is capable of increasing ignition efficiency in the range between low and no load operation of the engine and preventing flow out of mixtures from the combustion chamber in the range between medium and high load operation of the engine. This embodiment can achieve the results of improving fuel consumption, reducing the amounts of HC in the exhaust gases, and preventing unpleasant vibration and noise.

Figure 9:
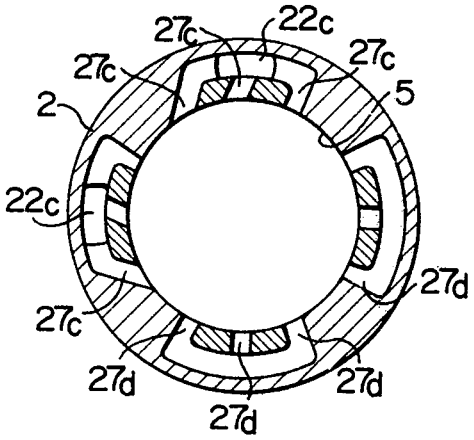
FIG. 9 is a sectional view taken along the line IX—IX in FIG. 8.
Figure 8:
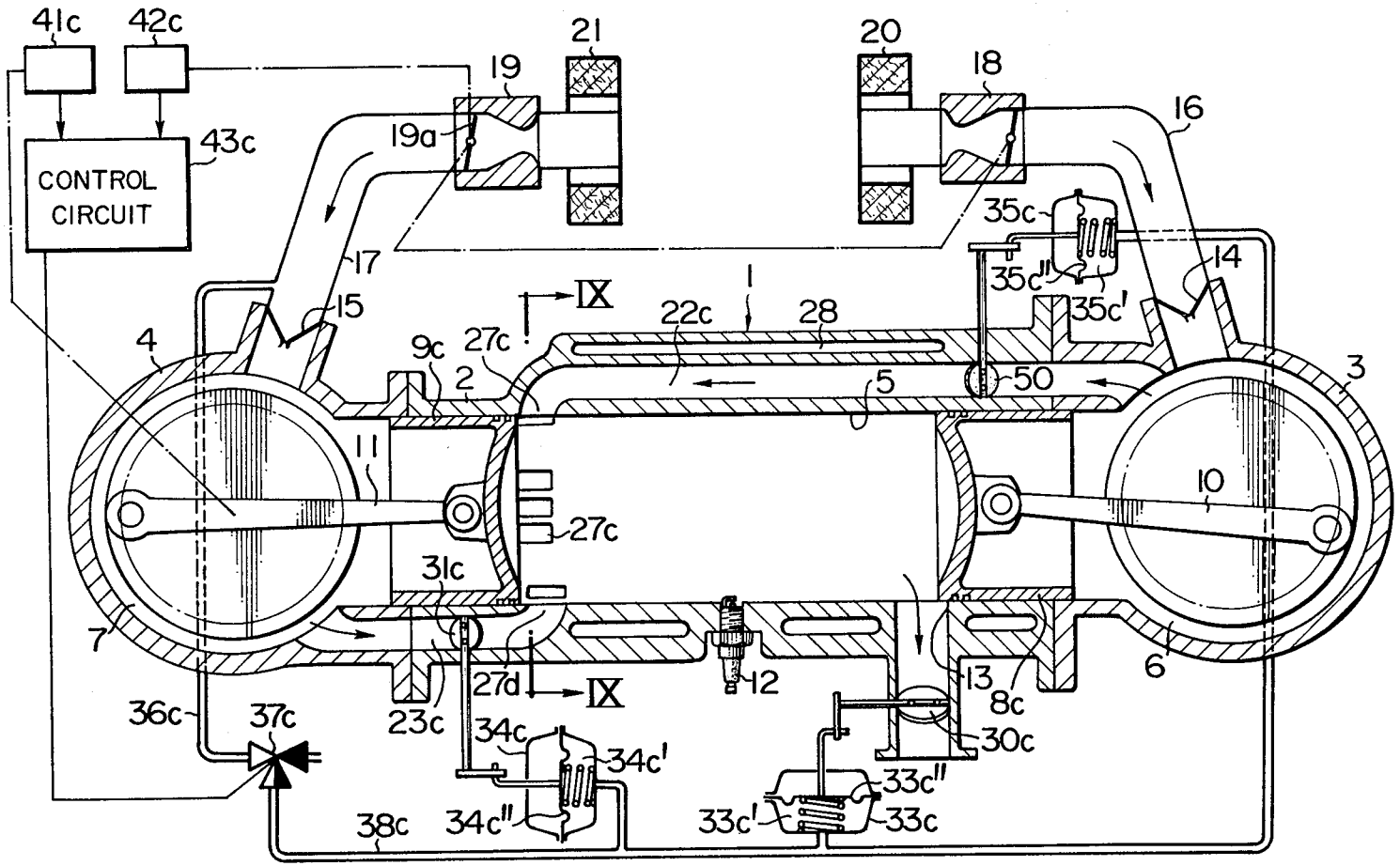
FIG. 8 is a schematic sectional view of the two-cycle engine comprising a third embodiment of the invention.

In FIGS. 8 and 9, the parts 1 to 21 are similar to those described with reference to the first embodiment except that the pistons 8C and 9C are concaved at their top, so that detailed description of these parts will be omitted.

The cylinder 5 is maintained in communication with the crank chamber 6 through two scavenging passages 22*c*, and the cylinder 5 is in communication with the crank chamber 7 through two scavenging passages 23*c*. First and second scavenging ports 27*c* and 27*d* of the scavenging passages 22*c* and 23*c* opening in the cylinder 5 are located in positions in which they are opened and closed by the piston 9C, and the scavenging ports 27*c* and 27*d* are three in number for each scavenging passage.

The scavenging passages 22*c* communicating the cylinder 5 with the crank chamber 6 of the exhaust port 13 side are located adjacent the engine cooling liquid passage 28, and rich mixtures flowing through the scavenging passages 22*c* are heated to a suitable temperature to promote their atomization. The scavenging passages 22*c* may be mounted near the exhaust gas passage to heat the rich mixtures by the heat of the exhaust gases.

The first scavenging ports 27*c* for introducing the rich mixtures therethrough into the cylinder 5 are formed such that they open toward the concaved portion of the portion 9C when the latter is located in the bottom dead center (the position illustrated in FIG. 8), so that the rich mixtures will flow toward the concaved portion of the piston 9C. On the other hand, the second scavenging ports 27*d* for admitting lean mixtures therethrough into the cylinder 5 are formed such that they open toward the central portion of the cylinder 5 when the piston 9C is located in the bottom dead center, so that air or lean mixtures will flow toward the ignition plug 12 and exhaust port 13.

The relative positions of the first and second scavenging ports 27*c* and 27*d* are set such that the second scavenging ports 27*d* open earlier than the first scavenging ports 27*c*. That is, changes in the open area S of the scavenging ports 27*c* and 27*d* caused by the reciprocating movement of the piston 9C or changes in the open area S relative to the crank angle $\theta$ are as shown by curves a and b in FIG. 10.

Figure 10:
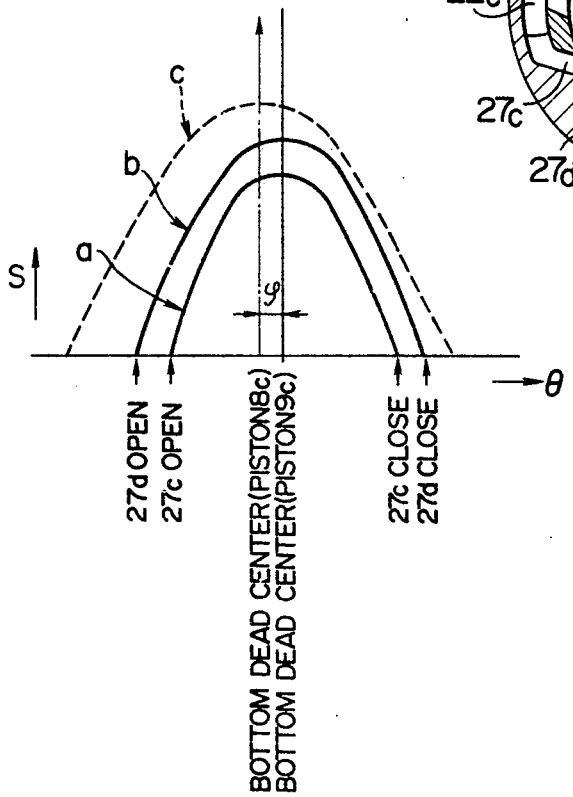
FIG. 10 is a graph in explanation of the operation of the two-cycle engine.

As shown in FIG. 10, the pistons 8C and 9C differ from each other in phase, with the former being advanced by $\phi$ in phase as compared with the latter. The exhaust port 13 has its open area varied as indicated by a curve c in FIG. 10 by the reciprocating movement of the piston 8C.

An exhaust throttle valve 30*c* of the butterfly type is mounted in the exhaust port 13, a scavenging gas throttle valve 31*c* of the butterfly type is mounted in each of the scavenging passages 23*c*, and a deflector 50 of the butterfly type is mounted in each of the scavenging passages 22*c*. The throttle valves 30*c* and 31*c* and the deflectors 50 are operated by diaphragm means 33*c*, 34*c* and 35*c* respectively. If suction negative pressure is introduced into diaphragm chambers 33*c*', 34*c*' and 35*c*' through an electromagnetic three-way valve 37*c* and conduits 38*c* and 36*c*, diaphragms 33*c*'', 34*c*'' and 35*c*'' are displaced against the biasing forces of springs, thereby actuating the throttle valves 30*c* and 31*c* in a manner to close the port and passages or throttle the flow therethrough.

The deflectors 50 are each formed of porous sintered metal which is slightly air permeable, so as to change the scavenging gas streams flowing through the scavenging passages 22*c* into moderate, gentle streams. The electromagnetic valve 37*c* has the function of switching a pressure signal introduced into the conduit 38*c* between suction negative pressure and atmospheric pressure. When energized, the valve 37*c* introduces negative suction pressure from conduit 36*c* to conduit 38*c*; when de-energized, the valve 37*c* introduces atmospheric pressure to conduit 38*c*.

Energization and de-energization of the electromagnetic valve 37*c* are controlled by a control circuit 43*c* which is supplied with signals from a rotational speed sensor 41*c* and a throttle switch 42*c*. The rotational speed sensor 41*c*, which detects the engine speed of the engine 1 and is known, may include a crank gear and an electromagnetic pick-up, for example. The sensor 41*c* produces an output signal in conformity with the rotational speed of the engine. The throttle switch 42*c*, which detects the degree of opening of the throttle valve 19*a* of the carburetor 19, is turned on when the degree of opening of the throttle valve 19*a* is below a predetermined level, so as to produce an electric signal indicating that the engine 1 is at no or low load operation.

The control circuit 43*c* comprises a comparator circuit and a drive circuit which are known, and produces and supplies an operative signal to the electromagnetic valve 37*c* when the engine is in the range between low and no load operation.

In the aforesaid construction, rich and lean mixtures formed in the carburetors 18 and 19 respectively are sucked into the crank chambers 6 and 7 through the inlet pipes 16 and 17 and the reed valves 14 and 15, in the same manner as in conventional two-cycle engines of the crank chamber compression type.

When the engine 1 is in the range between medium and high load operation, the control unit 43*c* de-energizes the electromagnetic valve 37*c* to thereby introduce atmospheric pressure into the diaphragm chambers 33*c*', 34*c*' and 35*c*' and to thereby open the throttle valves 30*c* and 31*c* and deflectors 50.

Thus, the rich mixtures and lean mixtures or air introduced into the crank chambers 6 and 7 respectively are supplied through scavenging passages 22*c* and 23*c* to the cylinder 1 in a scavenging stroke. Since the second scavenging ports 27*d* are set to open earler than the first scavenging ports 27*c*, the lean mixtures or air from the second scavenging ports 27*d* is first introduced into the cylinder 5 to remove the residual gases in the cylinder 5 through the exhaust port 13. With the second scavenging ports 27*d* opening toward the central portion of the cylinder 5, the lean mixtures or air will flow toward the ignition plug 12 and exhaust port 13, so that scavenging of the cylinder 5 can be carried out satisfactorily.

The first scavenging ports 27*c* are opened with a time lag behind the second scavenging ports 27*d* to allow rich mixtures to be fed to the cylinder 5. The rich mixtures thus supplied first form a rich mixture layer at the top of the piston 9C.

In the embodiment described, lean mixtures or air is first introduced into the cylinder 5 to remove the residual gases therefrom and then rich mixtures are introduced into the cylinder 5. By this arrangement, flow out of the fuel in the rich mixtures through the exhaust port 13 can be avoided and yet scavenging of the cylinder 5 can be carried out satisfactorily.

The mixtures in the cylinder 5 are ignited by means of the ignition plug 12 when the two pistons 8C and 9C are near the top dead center, so that combustion can take place smoothly.

The rich mixtures introduced into the cylinder 5 are heated to a suitable temperature as aforesaid and atomized, so that the mixtures can be positively ignited by the spark produced by the spark plug 12. Since the rich mixtures are atomized in this way, it is possible to increase the air-fuel ratio of the rich mixtures and to thereby improve fuel consumption.

Of the opposed two pistons 8C and 9C, the piston 8C on the exhaust port 13 side has its phase slightly advanced as compared with the other piston 9C so as to cause the exhaust port 13 to open earlier than would otherwise be the case. In this way, exhausting of exhaust gases is carried out to enable scavenging of the cylinder 5 to be performed satisfactorily. Thus, scavenging efficiency can be increased and flow out of rich mixtures can be avoided.

In the range between low speed, low load and no load operation of the engine, the degree of opening of the throttle valve 19*a* becomes small and the engine speed becomes low. Thus, the throttle switch 42*c* is turned on and the rotational speed sensor 41*c* detects low engine speed. Accordingly, the control circuit 43*c* produces an operative signal to energize the electromagnetic valve 37*c*, so as to introduce suction negative pressure into the diaphragm chambers 33*c*', 34*c*' and 35*c*'.

The diaphragm means 33*c*, 34*c* and 35*c* move the exhaust throttle valve 30*c* to a half-open position and fully close the scavenging gas throttle valves 31*c* and deflectors 50 respectively.

As the piston 8C passes the top dead center and moves toward the bottom dead center and the exhaust port 13 opens, the blow-down of the combusted gases occur, with the result that the pressure in the cylinder 5 becomes substantially equal to atmospheric pressure and scavenging is initiated. As the piston 9C moves together with the piston 8C toward the bottom dead center, the scavenging ports 27*d* first open. However, since the scavenging passages 23*c* are closed by the throttle valves 31*c*, no air or lean mixtures are fed to the cylinder 5. Further movement of the piston 9C toward the bottom dead center opens the scavenging ports 27*c* and allows rich mixtures to be fed from the crank chamber 6 to the top of the piston 9C in the cylinder 5 through the deflectors 50 and scavenging passages 22*c*.

The deflectors 50 are closed at this time. However, since the deflectors 50 are formed of porous sintered metal, the rich mixture can pass through the deflectors 50 and the streams of rich mixtures are changed into moderate, gentle streams by the deflectors 50.

As shown in FIG. 9, the scavenging ports 27*c* open substantially tangentially of the cylinder 5, so that the moderate, gentle streams of scavenging gases consisting of rich mixture flow in vortical form when introduced into the cylinder. Thus, the rich mixtures are not mixed with the residual gases in the cylinder 5 and are supplied in stratified relation, so that the residual gases and the rich mixtures from stratified masses in the cylinder 5.

After the piston 9C has reached the bottom dead center, the engine shifts to a compression stroke. In the compression stroke, the rich mixtures and the residual gases are located in stratified relation in the cylinder 5, and thus compression-ignition of the mixture in the same manner as mentioned in the description of the first embodiment takes place.

The combustion produces energy which drives crank shafts by way of the pistons 8C and 9C and the piston rods 10 and 11. The scavenging valves 31*c* can achieve the same effect by using porous metal similar to that used to form the deflectors 50.

The radicals are produced in the same manner as described by referring to FIG. 3 with regard to the first embodiment. The radicals greatly increase ignition efficiency, and compression-ignition of the mixtures can be effected at a low compression ratio of 4 to 10, as described by referring to FIG. 4 with regard to the first embodiment. The generation of radicals for effecting compression-ignition of the mixtures enables ignition to be positively effected in each cycle and allows the engine to be operated with little vibration and noise. An increase in ignition efficiency is conductive to a great reduction in the amounts of HC in the exhaust gases. The rich mixture required for effecting compression-ignition need not be large in amount, so that the air-fuel ratio of the mixtures can be increased throughout the whole engine operation and fuel consumption can be improved.

Figure 11:
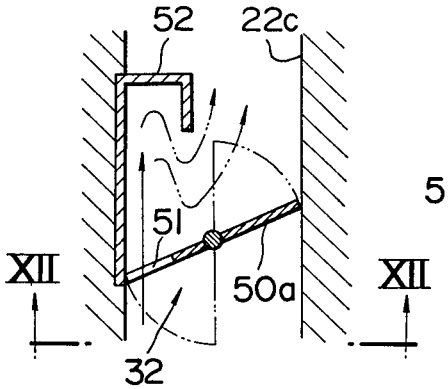
FIG. 11 is a sectional view of the essential portions of the engine showing a modification of the deflector.
Figure 12:
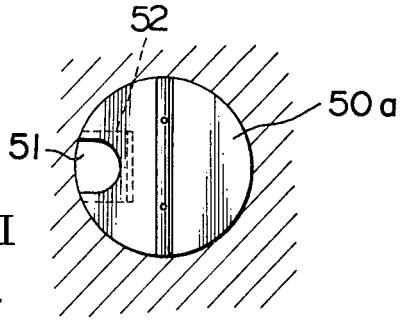
FIG. 12 is a sectional view taken along the line XII—XII in FIG. 11.
Figure 13:
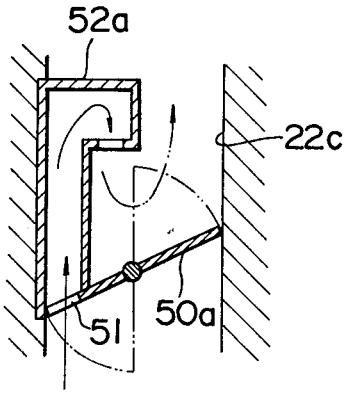
FIGS. 13 and 14 are sectional view of further modifications of the deflector.
Figure 14:
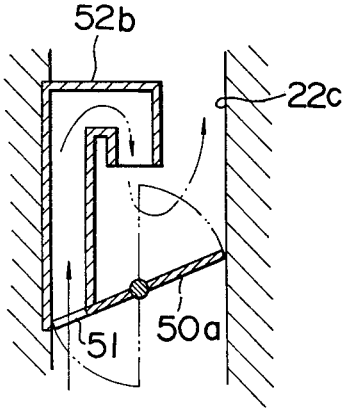

In the third embodiment shown and described hereinabove, butterfly valves formed of porous sintered metal are used as the deflectors 50. However, as shown in FIGS. 11 and 12, each of the deflectors 50 may consist of a butterfly valve 50*a* of non-porous material formed with a cutout 51 therein, and a baffle plate 52 substantially in the form of a letter U disposed upstream of the cutout 51. In place of the baffle plate 52, an enclosure member 52*a* forming an L-shaped flow path may be used as shown in FIG. 13. Also, as shown in FIG. 14, a pipe 52*b* bent substantially into an L-shape may be used in place of the enclosure member 52*a*.

Figure 15:
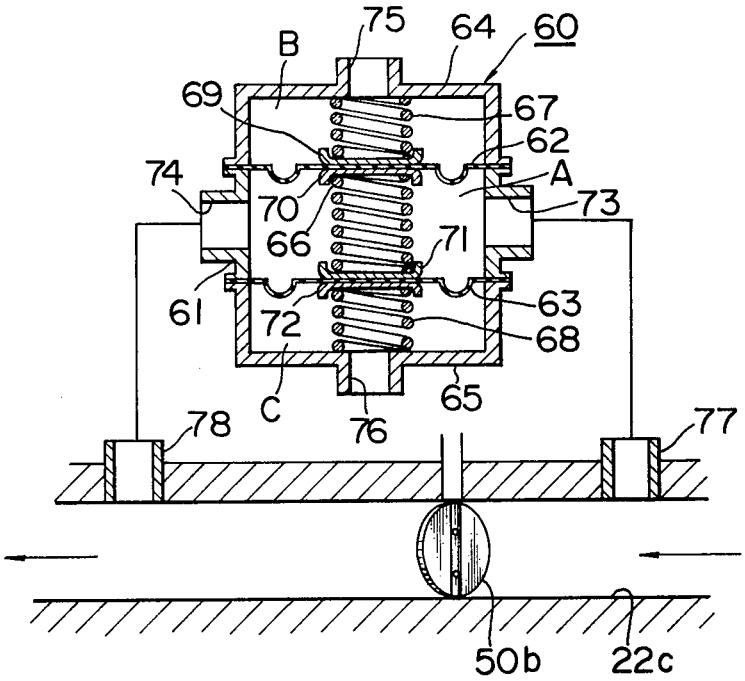
FIG. 15 is a sectional view of the essential portions of the engine showing a resonator.

In place of each of the deflectors 50, a scavenging gas throttle valve 50*b* of non-porous material may be used in combination with a resonator 60 a shown in FIG. 15, to attain the end of causing streams of mixtures to be introduced into the cylinder 5 in such a manner that the streams are in stratified relation with respect to the residual gases in the cylinder 5, by suitably timing the supply of the mixtures. In FIG. 15, the resonator 60 is mounted in a manner to bypass the scavenging gas throttle valve 50*b* in the scavenging passage 22*c*. The scavenging gas throttle valve 50*b* is connected to diaphragm means, 35*c* not shown in FIG. 15.

The resonator 60 performs the function of intermittently feeding the rich mixtures to the scavenging ports 27*c* in moderated and gentle flow. The resonator 60 comprises a housing 61, covers 64 and 65 secured to opposite sides of the housing 61, diaphragms 62 and 63 mounted between the housing 61 and the covers 64 and 65 respectively, and three chambers A, B and C defined between the diaphragms 62 and 63 and the covers 64 and 65.

Compressive coil springs 66, 67 and 68 are mounted in the chambers A, B and C respectively to urge the diaphragms 62 and 63 to move by their biasing forces, through spring supports 69, 70, 71 and 72 serving as resonating weights which are secured to opposite sides of each diaphragm.

The chamber A is maintained in communication with the scavenging passage 22*c* through two communicating ports 73 and 74 formed in the housing 61 and two ports 77 and 78 formed in the passage 22*c*, while the chambers B and C communicate with the atmosphere through communicating ports 75 and 76 formed therein.

In this construction, the scavening gas throttle valve 50*b* is closed and rich mixtures are introduced into the scavenging port 27*c* by way of the port 77, resonator 60 and port 78, when the engine operates at low load. As the pistons 8C and 9C move toward the bottom dead center in a scavenging stroke, rich mixtures from the crank chamber 6 flows into the middle chamber A of the resonator 60. The chamber A is expanded by the compressed gases and the chambers B and C are contracted. At this time, the spring 66 in chamber A is expanded and the springs 67 and 68 in chambers B and C are contracted.

As the piston 9C further moves toward the bottom dead center and the scavenging ports 27*c* are opened, the rich mixtures in chamber A of each resonator 60 flow into the cylinder 5 and the pressure in chamber A is reduced. During the supply of the rich mixtures, chambers A, B and C of each resonator 60 are placed out of balance, so that the spring 66 of chamber A is compressed by the springs 67 and 68 of chambers B and C, thereby promoting the flow of the rich mixtures to the cylinder 5.

When the springs 67 and 68 of chambers B and C have expanded to their limit, the diaphragms 62 and 63 begin to move in the reverse directions after they have become stationary, and the spring in chamber A begins to expand, thereby increasing the volume of chamber A. This causes a sudden reduction to occur in the pressure in chamber A and the pressure in each scavenging passage 22*c*, thereby interrupting the supply of the rich mixtures to the cylinder 5.

Thus, by bringing this period of interruption of supply into agreement with the bottom dead center of the piston 9C, it is possible to positively interrupt the supply of the rich mixtures when the piston 9C moves toward the top dead center, so that intermittent or timed supply of the rich mixtures can be realized.

By setting the biasing forces of the springs 66–68 and the weights of the spring supports 69–72 at suitable values, it is possible to cause the resonator to sustain an inherent periodic chanee in pressure. This makes it possible to effect intermittent supply of mixtures in which mixtures are supplied only when the piston moves to the bottom dead center side, and allows the mixtures to be fed to the cylinder in stratified relation without disturbing the residual gases in the cylinder.

By feeding the mixtures in stratified relation, it is possible to effect compression-ignition of the mixtures without fail.

In the embodiment shown and described hereinabove, the residual gases and the rich mixtures have been described as forming two stratified masses in the cylinder. However, in order to improve fuel consumption, it is preferable that the residual gases, rich mixtures an lean mixtures form three stratified masses in the cylinder.

Figure 16:
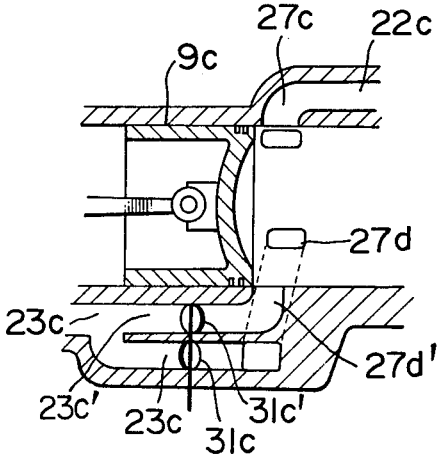
FIG. 16 is a sectional view showing a modification of the scavenging passage.

This end can be attained by providing a scavenging passage 23*c*′ branching from each scavenging passage 23*c* and opening in a scavenging port 27*d*′ which is disposed in a position in which it opens later than the scavenging ports 27*c*, and by mounting in the scavenging passage 23*c*′ a throttle valve 31*c*′ which opens when the throttle valve 31*c* closes and closes when the throttle valve 31*c* opens, as shown in FIG. 16.

In the aforesaid embodiment, carburetors are used for forming mixtures. However, fuel injection valves may be mounted in the mixture conduits or scavenging passages for forming mixtures.

From the foregoing description, it will be appreciated that in this embodiment, it is possible to increase scavenging efficiency and avoid flow out of the rich mixture in the range between medium and high load operation of the engine and to effect compression-ignition of the mixtures at a low compression ratio of 4 to 10 in the range between low and no load operation of the engine. It is possible to positively ignite the mixture in each cycle, to operate the engine with little vibration and noise, to improve fuel consumption and to reduce the amounts of HC in the exhaust gases.

What is claimed is:

1. A two-cycle engine having a cylinder provided with an exhaust port and scavenging port means, a first crank case and a second crank case each connected to one of two ends of said cylinder, a first piston and a second piston housed in said cylinder in opposed relationship, said first piston being operative to open and close said exhaust port, said second piston being operative to open and close said scavenging means and second air-fuel mixture supplying means connected to said first crank case an said second crank case respectively, comprising:

first passage means formed outside of said cylinder to connect said first crank case with said scavenging port means for feeding an air-fuel mixture from said first crank case to said cylinder;

second passage means formed outside of said cylinder to connect said second crank case with said scavenging port means for feeding an air-fuel mixture from said second crank case to said cylinder; and means, cooperative with said first and second passage means, located upstream of said scavenging port means for restricting the flow of said air-fuel mixtures in said first and second passage means to moderate the flow of said air-fuel mixtures in the vicinity of said scavenging port means in said cylinder, said first air-fuel mixture supply means is adapted to supply rich mixtures and said second air-fuel mixture supply means is adapted to supply lean mixture, and said scavenging port means comprises first set of scavenging ports communicating with said first passage means for supplying said rich mixtures to said cylinder and second set of scavenging ports communicating with said second passage means and located in positions in which they are open earlier than said first set of scavenging ports for supplying said lean mixture to said cylinder, and said cylinder further comprises deflector means mounted in said first passage means for moderating streams of said rich mixtures supplied from said first crank case to said cylinder through said first set of scavenging ports in the range between low and no load operation of the engine, scavenging gas throttle valve means mounted in said second passage means for interrupting the supply of said lean mixture from said second crank case to said cylinder through said second set of scavenging ports in the range below low and no load operation of the engine, and an exhaust throttle valve mounted in said exhaust port for throttling exhaust gases in the range between low and no load operation of the engine, whereby said rich mixtures can be ignited by compression-ignition in the range below low and no load operation of the engine and can be ignited by spark ignition by means of a spark plug in the range between medium and high load operation of the engine.

2. A two-cycle engine as claimed in claim 1, wherein said scavenging port means is formed such that said air-fuel mixtures are introduced into said cylinder by flowing along the top of said second piston.

3. A two-cycle engine as claimed in claim 1, wherein said first piston is advanced in phase as compared with said second piston.

4. A two-cycle engine as claimed in claim 1 or 3, wherein said first piston and said second piston are concaved in shape at their top.

5. A two-cycle engine having a cylinder, means defining exhaust port and scavenging port means, first and second crank cases operatively attached to opposite ends of said cylinder, first and second pistons positioned oppositely one another in said cylinder, said first and second pistons serving to open and close said exhaust port means and said scavenging port means, respectively, said scavenging port means includes first and second groups of scavenging ports, first and second air/fuel supply means for respectively supplying rich and lean air/fuel mixtures from said first and second crank cases to said first and second groups of scavenging ports, said first and second air/fuel supply means and said exhaust port means each include restriction means for controlling flow therethrough, so that under low and no load operating conditions the flow of lean air/fuel mixtures is shut off, the flow of rich air/fuel mixtures is reduced and the flow of exhaust gases is adjusted so that the rich air/fuel mixture delivered to the cylinder can be ignited by compression-ignition conditions within the cylinder and when under medium and high load operation, the restriction means controls flow within the engine so that the flow through said first and second air/fuel supply means and through said exhaust port means is open and wherein said second group of scavenging ports open earlier than said first group of scavening ports whereby the air/fuel mixture delivered to the engine can be ignited by spark ignition.

6. An engine as in claim 5 wherein said restriction means located in said first air/fuel supply means operates between open and closed positions and allows a predetermined flow of the rich air/fuel mixture when in a closed position.

7. An engine as in claim 5 or 6 wherein said first and second air/fuel supply means each include passage means formed outside of said cylinder for connecting said first and second crank cases, respectively, to said first and second groups of scavenging ports.

8. An engine as in claim 7 wherein said restriction means in said first and second air/fuel supply means are located within said passage means.

9. An engine as in claims 1, 5 or 6 wherein the lean air/fuel mixture comprises air.

* * * * *